United States Patent [19]

Mendenhall

[11] 4,112,259

[45] Sep. 5, 1978

[54] AUTOMATIC PHASE CONTROLLED PILOT SIGNAL GENERATOR

[75] Inventor: Geoffrey N. Mendenhall, Quincy, Ill.

[73] Assignee: Harris Corporation, Cleveland, Ohio

[21] Appl. No.: 781,101

[22] Filed: Mar. 25, 1977

[51] Int. Cl.[2] ..... H04H 5/00

[52] U.S. Cl. ..... 179/15 BT; 307/261; 328/133; 323/101

[58] Field of Search ..... 179/15 BT, 15 BP; 325/36; 307/261; 328/155, 133; 323/101

[56] References Cited

U.S. PATENT DOCUMENTS

| | | | |
|---|---|---|---|
| 3,328,688 | 6/1967 | Brooks | 328/133 |
| 3,660,607 | 5/1972 | Mack | 179/15 BT |
| 3,750,035 | 7/1973 | Crow | 328/133 |
| 3,789,323 | 1/1974 | Andersen et al. | 324/77 E |
| 3,821,652 | 6/1974 | Wiebe et al. | 307/261 |
| 3,896,268 | 7/1975 | Streed | 179/15 BT |

*Primary Examiner*—Douglas W. Olms

[57] ABSTRACT

A stereo FM pilot signal generator which includes an automatic phase correction loop so as to automatically synchronize the phase between the pilot signal and the stereo switching signal. A parallel clocked divider/decoder is included for generating a 38 kHz square wave, to be used in a stereo switching modulator, and a 19 kHz square wave so that the two square wave signals are substantially in phase synchronism with one another. The 19 kHz square wave is directed through a controllable phase adjuster and then through a filter which serves to remove higher harmonics therefrom so that only the fundamental, 19 kHz sine wave signal remains. The phase of the 19 kHz square wave signal is compared with the phase of the 19 kHz sine wave signal by a phase comparator which provides a control signal to the phase adjuster, and which adjusts this control signal until the 19 kHz sine wave is substantially in phase synchronism with the 19 kHz square wave. In addition, a specific phase comparator is described which includes two flip-flops which are respectively responsive to lead and lag between two input signals.

6 Claims, 3 Drawing Figures

AUTOMATIC PHASE CONTROLLED PILOT SIGNAL GENERATOR

BACKGROUND AND FIELD OF THE INVENTION

The present invention relates to stereophonic FM broadcasting, and more particularly to a system for producing a 19 kHz pilot signal whose phase is automatically adjusted to correspond to the phase of the switching signal used for generating the composite stereo signal.

In stereo FM broadcasting, the composite stereo signal which is to be broadcast is usually generated by means for a switching modulator which alternately samples the left and right signals at a 38 kHz switching rate. A 19 kHz pilot signal is added to the composite signal for purposes of synchronizing the operation of the stereo demodulators which are provided in stereo FM receivers. For these demodulators to operate properly, the pilot signal must be in exact phase synchronism with the switching signal. In the prior art, this pilot signal was derived by first dividing down the 38 kHz switching signal to provide a 19 kHz square wave. A 19 kHz sine wave was then generated by filtering the 19 kHz square wave to remove all harmonic components above the fundamental. Unfortunately, when the 19 kHz pilot signal is generated in this manner, arbitrary phase shifts are introduced in the process so that phase synchronism between the 38 kHz switching signal and the pilot signal is hopelessly lost. Consequently, a phase adjustment was generally provided which was manually set so that the output signal of the filter was in exact synchronism with the 38 kHz switching signal. A system of this nature is described in the patent to Anderson et al. 3,789,323. This manual phase adjustment, however, was difficult to set in the first instance, and was prone to drift thereafter so that phase synchronism, even if achieved in the first instance, was later lost. This resulted in degradation of stereophonic separation of the left and right channels in subsequent demodulation of the composite signal.

The present invention provides a system wherein a pilot signal is produced which is in exact phase synchronism with the switching signal, and which does not drift from this desired phase relationship.

In accordance with the present invention, a circuit is provided for generating a switching signal and a pilot signal which is in exact phase synchronism therewith. The switching signal and a square wave pilot signal are derived in such a manner that the square wave pilot signal and the switching signal are in exact phase synchronism. The square wave pilot signal is then directed through a controllable phase adjuster circuit and into a filter. The filter serves to remove all harmonics above the fundamental so as to produce a sine wave pilot signal. The output of the filter is directed to a phase comparator which compares the phase of the sine wave pilot signal with the phase of the square wave pilot signal. The phase comparator provides a control signal which is used to adjust the phase correction provided by the phase adjuster so as to phase synchronize the sine wave and square wave pilot signals.

In accordance with another aspect of the present invention, a phase comparator is provided which is responsive to first and second input signals to provide an output signal which is responsive to any phase difference between the first and second input signals. A "lead" flip-flop which is included in the comparator is connected so as to provide an output pulse train wherein the width of the pulses provided thereby is dependent upon the amount by which one of the input signals leads the other input signal in phase. A "lag" flip-flop is also included and is connected so as to provide a second pulse train wherein the width of the pulses provided thereby is dependent upon the amount by which the one input lags the other input. An integration circuit is provided for integrating the difference between the two pulse trains to thereby provide the output signal.

BRIEF DESCRIPTION OF THE DRAWINGS

The foregoing and other objects and advantages of the present invention will become more readily apparent from the following description of the preferred embodiment, as taken in conjunction with the accompanying drawings which are a part hereof and wherein.

DETAILED DESCRIPTION OF THE DRAWINGS

Figure 1:
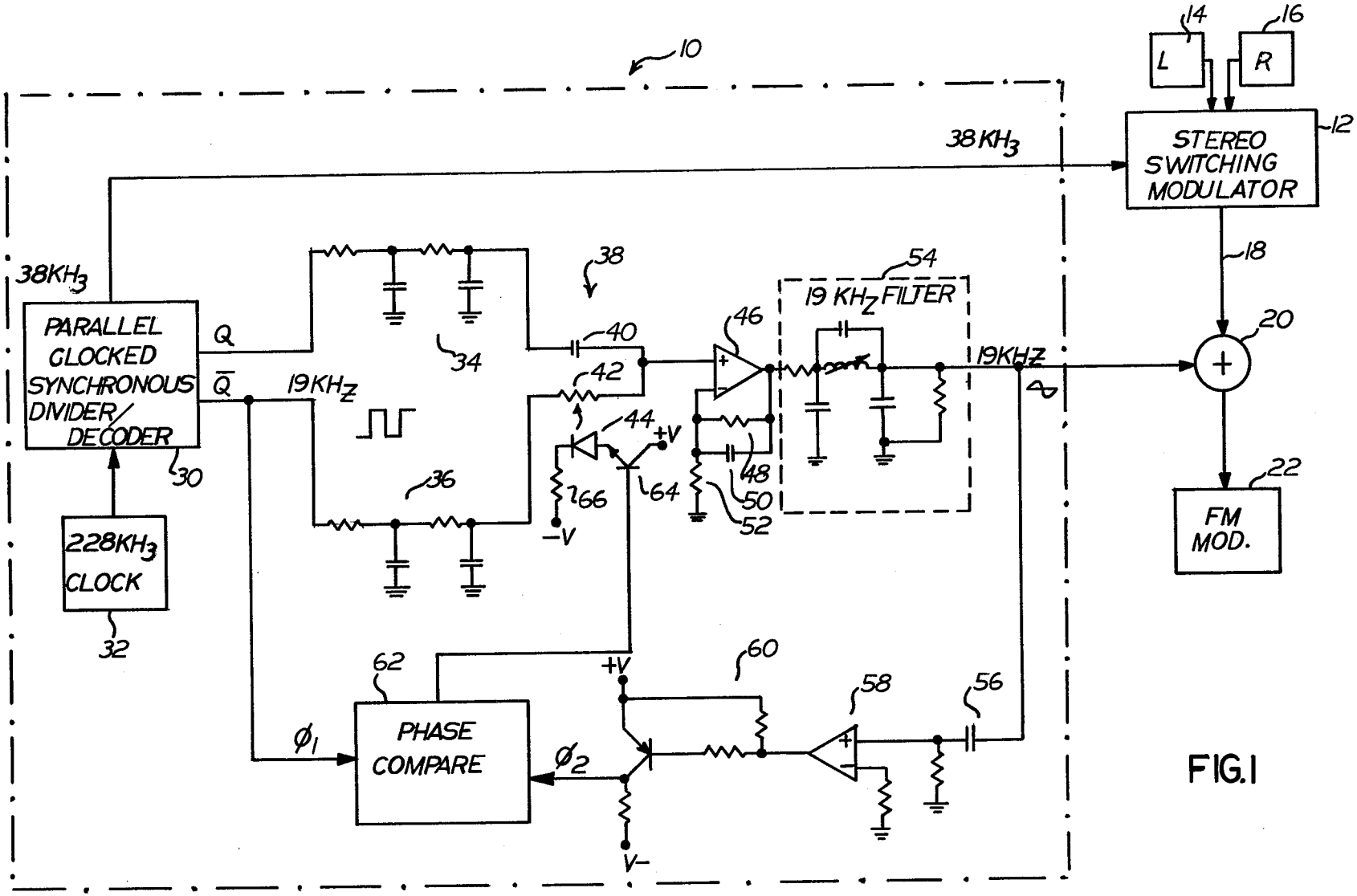
FIG. 1 is a schematic diagram of a switching signal and pilot signal generator in accordance with the present invention.

There is illustrated in FIG. 1 a signal generator 10 for generating a 19 kHz sine wave signal in close phase synchronism with a 38 kHz square wave signal. The 38 kHz square wave signal is directed to a switching modulator 12 which frequency modulates the left and right signal sources 14 and 16 into a composite signal which is provided on an output line 18. This composite signal will then be combined with a 19 kHz pilot signal by a summing circuit 20. The sum signal is used for frequency modulating a carrier signal by FM modulator 22.

A receiver station must operate synchronously with the 38 kHz switching signal in order to efficiently demodulate the composite signal provided by the stereo switching modulator. It is for this purpose that the 19 kHz pilot signal is provided. The pilot signal serves as a phase and frequency reference for synchronizing the operation of the stereo demodulator. Therefore, unless this 19 kHz pilot signal is precisely synchronized in phase with a 38 kHz switching signal, degradation in separation between the left and right channels will result.

The pilot signal generator 10 shown in FIG. 1 can be used for accurately deriving a 38 kHz square wave signal and a 19 kHz sine wave signal wherein the two signals are in phase synchronism with respect to one another. The present invention includes a parallel clocked, synchronous divider/decoder 30 which is clocked from a higher frequency signal source 32 so that the 38 kHz and 19 kHz signal are simultaneously derived. Since the circuits which provide the 38 kHz and 19 kHz signals are simultaneously clocked by a single higher frequency clock source 32, they will inherently be generated in phase synchronism.

Divider/decoder 30 provides two 19 kHz square wave outputs Q and $\overline{Q}$ which are in phase opposition with one another. The Q and $\overline{Q}$ outputs of the divider/decoder 30 are directed through respective low-pass filters 34 and 36 to a voltage controlled phase adjuster indicated generally at 38. The low-pass filters serve to in some measure smooth the signal supplied by the divider/decoder 30 to the voltage controlled phase adjuster 38.

Voltage controlled phase adjuster 38 includes a capacitor 40, and a photosensitive resistor 42 which is optically connected to a light-emitting diode 44. The junction between the capacitor 40 and the photosensitive diode 42 is connected to a buffer amplifier 46 and thence to the remainder of the circuit. The signal input to buffer amplifier 46 will constitute a vector sum of the two 19 kHz outputs of divider/decoder 30. Since these outputs of divider/decoder 30 are 180° out of phase with respect to one another, the phase of the vector sum signal may be adjusted by controlling the relative contribution thereto of the two 19 kHz signals.

The amount which each of these signals contributes to the vector sum is dependent upon the impedance level of the photosensitive resistor 42. This, in turn, is dependent upon the amount of light emitted by light-emitting diode 44. A phase comparator network (which will be described in greater detail hereinafter) controls the amount of light emitted by light-emitting diode 44. The vector sum signal supplied to buffer/amplifier 46 will therefore have a frequency of 19 kHz, and a phase which is controlled by phase comparator 62. Additionally, the vector sum signal will have a substantially constant amplitude over a range of phase adjustments.

Buffer amplifier 46 is connected in a standard non-inverting amplifier arrangement whereby a feedback resistor 48 and an input resistor 50 combine to determine the gain supplied by the buffer amplifier 46. Preferably, these resistors will be scaled so as to provide buffer amplifier 46 with a small amount of gain to compensate for the amplitude loss in the voltage controlled phase adjuster 38. A feedback capacitor 52 is also included to provide some additional filtering of the output signal supplied by buffer amplifier 46.

A 19 kHz filter 54 responds to the output of buffer amplifier 46 to remove all frequency components above 19 kHz. This filter may conveniently comprise a 3-pole elliptic-type filter having a zero in its transfer characteristics at the third harmonic of the 19 kHz pilot signal. The third harmonic of the 19 kHz signal will thus be very efficiently removed, whereas all higher order harmonics will be adequately removed due to the third order nature of the filter.

The output provided by 19 kHz filter 54 will comprise a very pure sine wave having a frequency determined by the 19 kHz square wave provided by the divider/decoder 30. This signal will thus be in harmonic synchronism with the 38 kHz switching signal. The phase of this signal, however, will be indeterminate since varying degrees of phase shift will be introduced by the filters 34 and 36, phase adjuster 38, buffer amplifier 46, and 19 kHz filter 54. The phase of the 19 kHz sine wave must therefore be monitored and adjusted so as to correspond closely to the phase of the 38 kHz switching signal.

The present invention contemplates comparing the phase of this 19 kHz sine wave with the phase of the 19 kHz square wave provided by the divider/decoder 30. This is possible since it is known that the phase of the 19 kHz square wave corresponds quite closely to the phase of the 38 kHz switching signal. The 19 kHz sine wave provided by 19 kHz filter 54 is thus directed through a blocking capacitor 56 to a high speed comparator 58 which serves to provide a square wave output signal having transitions precisely at the zero crossings of the 19 kHz sine wave. A level shifter 60 is then provided for adjusting the level of the output signals supplied by high speed comparator 58 to voltage levels compatible with the phase comparator 62. Very little propagation delay is associated with level shifter 60 and high speed comparator 58, so that it is known that the square wave ($\phi_2$) provided by level shifter 60 will be in phase synchronism with the 19 kHz sine wave.

Phase comparator 62 serves to compare the phase of the square wave signal ($\phi_2$) supplied by level shifter 60 with the phase of the 19 kHz square wave ($\phi_1$) provided by divider/decoder 30. A control voltage will be supplied by the phase comparator which will be increased or decreased in response to lead or lag of $\phi_2$ with respect to $\phi_1$. This control signal is directed to a transistor driver circuit 64 having the light-emitting diode 44 and a resistor 66 connected in the emitter circuit thereof. Since transistor driving circuit 64 is connected in an emitter-follower arrangement, the current directed through light-emitting diode 44 will be directly related to the amplitude of the control signal by phase comparator 62. Consequently, the amount of light emitted by light-emitting diode 44 may be adjusted by adjusting the level of the control signal supplied by phase comparator 62. This will cause a corresponding adjustment in the phase of the 19 kHz sine wave signal. Phase comparator 62 will vary the DC level supplied to transistor driving circuit 64 until the two input signals thereto are in phase synchronism.

Figure 2:
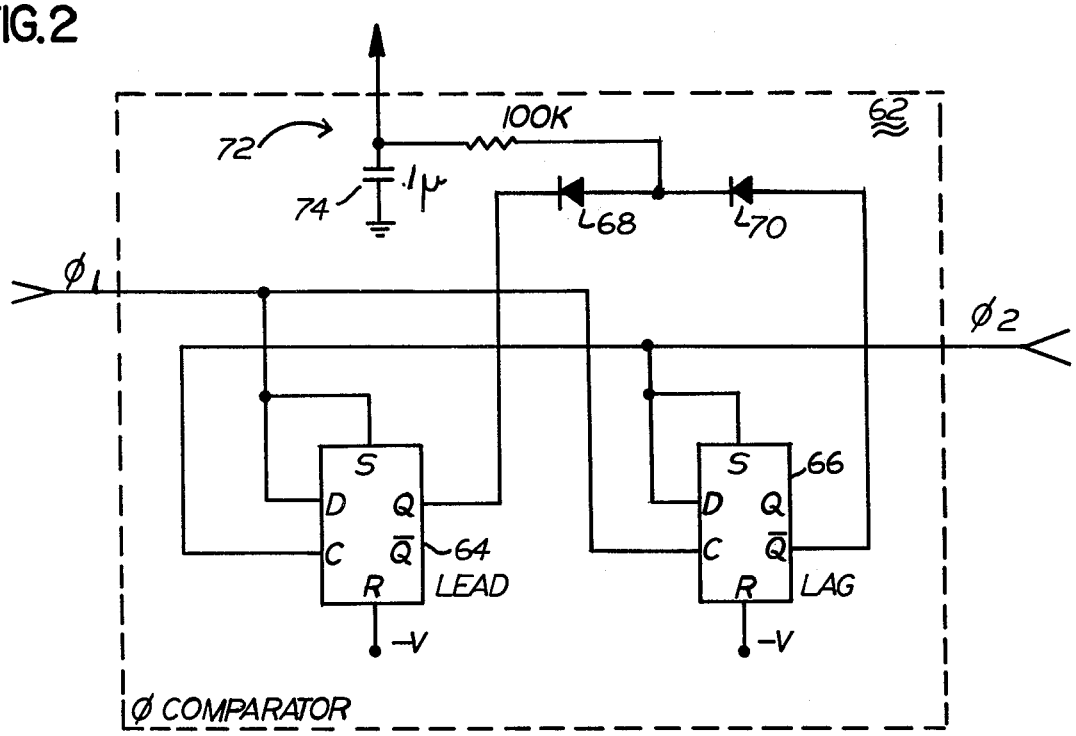
FIG. 2 is a schematic illustration of the phase comparator used in the system of FIG. 1; and, FIG. 3 is a timing diagram used for the purpose of describing the operation of the phase comparator of FIG. 2.

Referring now to FIG. 2, a more detailed diagram of phase comparator 62 is shown. It will thus be seen that phase comparator 62 is comprised of two type "D" flip-flops 64 and 66 which are connected in a specific arrangement. When connected in the arrangement shown, flip-flop 64 will serve to provide a pulse waveform output wherein the pulses will have a width linearly dependent upon the amount by which the $\phi_2$ input signal leads the $\phi_1$ signal, whereas flip-flop 66 will provide a pulse waveform wherein the width of the pulses is linearly dependent upon the amount by which the $\phi_2$ input signal lags the $\phi_1$ input signal. The outputs of the lead and lag flip-flops 64 and 66 are connected to a circuit which provides a control signal having an amplitude corresponding to the integral of the difference between the two pulse waveforms. This function is performed by diodes 68 and 70 in conjunction with an integrator 72 comprised of a resistor and a capacitor.

Flip-flops 64 and 66 may comprise a single RCA CD4013A integrated circuit (this is a COS/MOS dual "D"-type flip-flop). Thus, these flip-flops have level triggered, asynchronous SET inputs which may be used to force the flip-flop into a "set" condition by applying a high logic level thereto. These flip-flops additionally have leading-edge triggered CLOCK inputs which may be used to enter the information provided on the D input thereto into the flip-flop. Thus, for example, if both the set and reset lines are in low logic levels, and a leading edge is supplied on the CLOCK input, the Q output thereof will latch in the same logic state which is supplied to the D input thereto.

Figure 3:
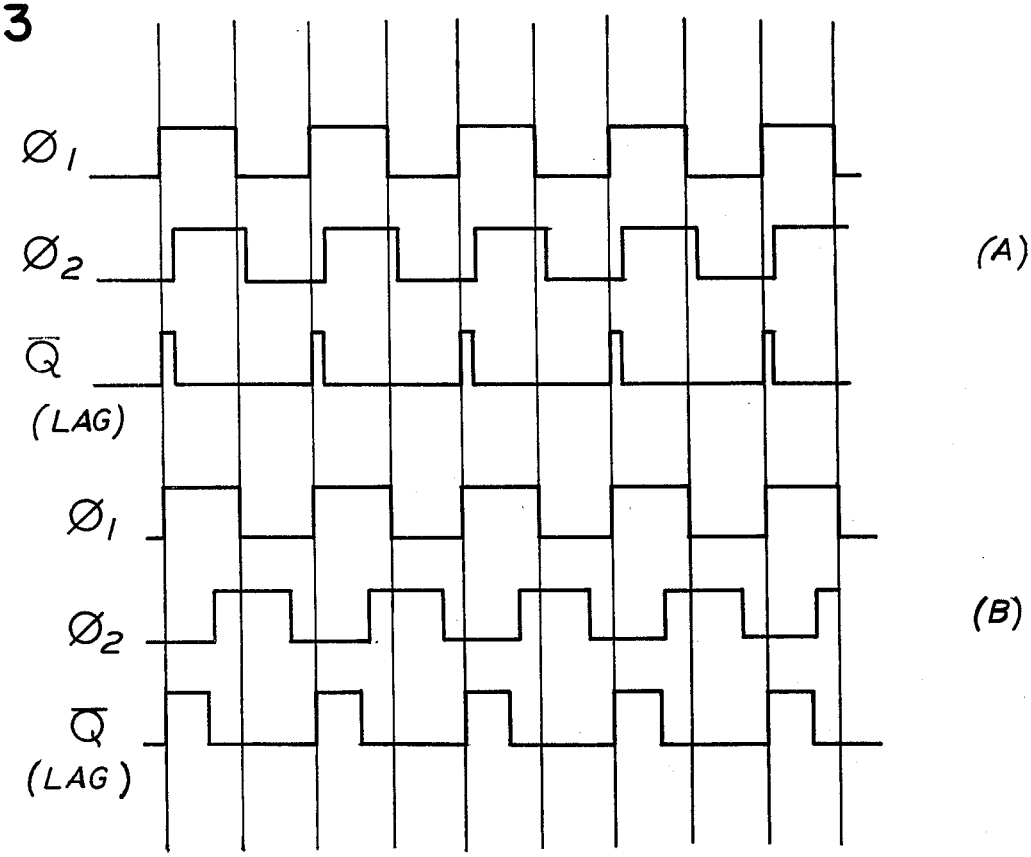

The operation of flip-flops 64 and 66 may be more readily understood through reference to the timing diagrams shown in FIGS. 3*a* and 3*b*. Since these flip-flops operate independently of one another and are connected in similar fashions, the timing diagram illustrates the operation of only lag flip-flop 66.

FIGS. 3*a* and 3*b* both illustrate circumstances in which the $\phi_2$ input to the phase comparator lags the $\phi_1$ input. The SET and D inputs to flip-flop 66 are both connected to the $\phi_1$ input line of the phase comparator. Since the SET input to the flip-flop is level triggered and operates asynchronously (that is, without regard to signals supplied on the clock input thereto), the flip-flop will be forced into a "set" condition whenever the $\phi_2$ input to the phase comparator is at a high logic level. When flip-flop 66 is in a set condition, the $\overline{Q}$ output thereof will be at low logic level.

The CLOCK input to flip-flop 66 is connected to the $\phi_1$ input to the phase comparator. Since $\phi_2$ lags $\phi_1$ in both FIGS. 3*a* and 3*b*, the leading edge of $\phi_1$ is supplied on the clock input of lag flip-flop 66 at a time when low logic level signals are supplied to both the SET and RESET inputs. The flip-flop will therefore respond to the leading edge of $\phi_1$ by causing the Q output to take on the logic level provided on the D input thereto; that is, it will take on a low logic level. The $\overline{Q}$ output of flip-flop 66 will therefore shift from a low logic level to a high logic level. When the $\phi_2$ input to phase comparator 62 subsequently shifts to a high logic level, flip-flop 66 will once again be forced into a set condition, wherein the $\overline{Q}$ output is returned to a low logic level.

The $\overline{Q}$ output of lag flip-flop 66 will therefore remain at a high logic level for only that period of time between the leading edge of the $\phi_1$ input and the leading edge of the $\phi_2$ input. Thus, in the condition when the $\phi_2$ input lags the $\phi_1$ input by only a small amount, very narrow pulses will be provided at the output of the lag flip-flop (FIG. 3*a*). When the $\phi_2$ input lags the $\phi_1$ input by a larger amount, however, the pulses supplied on the output of the lag flip-flop 66 will be of greater width (FIG. 3*b*).

When the $\phi_2$ input leads the $\phi_1$ input, however, the leading edge of the $\phi_2$ signal will occur when the flip-flop is being forced into a set condition. Because of this, the leading edge seen at the CLOCK input of flip-flop 66 will be ignored and the $\overline{Q}$ output thereof will remain at a low logic level. Therefore, whenever the $\phi_2$ input leads the $\phi_1$ input, the output of flip-flop 66 will remain at a low logic level continuously.

Lead flip-flop 64 is connected similarly to lag flip-flop 66, however the $\phi_1$ and $\phi_2$ inputs thereto are reversed so that flip-flop 64 will respond to the $\phi_2$ input leading, rather than lagging, the $\phi_1$ input. Additionally, the output of flip-flop 64 is taken from the Q output, rather than the $\overline{Q}$ output, so that the pulses will be of the opposite polarity of the pulses provided by the output of flip-flop 66. In other words, the output of flip-flop 64 will generally remain at a high logic level, and will include negative going pulses having a width dependent upon the amount by which the $\phi_2$ input leads the $\phi_1$ input. During the time in which the $\phi_2$ input lags the $\phi_1$ input, however, the output of flip-flop 64 will remain at a continous high logic level.

The Q output of flip-flop 64 is gated to integrator 72 by means of diode 68, while the $\overline{Q}$ output of flip-flop 66 is gated to integrator 72 by means of diode 70.

When the $\phi_2$ input leads the $\phi_1$ input in phase, the output of the lag flip-flop will remain at a continuous low level. Diode 70 will thus be placed in a blocking condition and will serve to substantially disconnect flip-flop 66 from the integrating circuit 72. Lead flip-flop 64, however, will be producing negative going pulses, the width of which will be determined by the amount by which the $\phi_2$ input leads the $\phi_1$ input. These pulses will be gated to integrator 72 through diode 68 and will cause the voltage developed across capacitor 74 to be gradually diminished. The rate of change will depend upon the width of the pulses. As the voltage diminishes, phase adjuster 38 will re-adjust the phase of $\phi_2$ so as to decrease the amount of phase lead until phase synchronism is achieved.

When the $\phi_2$ input lags the $\phi_1$ input, however, the output of flip-flop 64 will remain at a continuous high level. Diode 68 will thus be placed in a blocking condition, and will serve to disconnect flip-flop 64 from the integrating circuit 72. Flip-flop 66, on the other hand, will be producing positive going pulses having the width determined by the amount by which the $\phi_2$ input lags the $\phi_1$ input. These positive going pulses will be gated through diode 70 and will serve to gradually increase the voltage seen across capacitor 74. This will cause the voltage controlled phase shifter 38 to adjust the phase of the $\phi_2$ input until phase synchronism has been achieved.

It will thus be seen that this phase comparator will serve to monitor the amount of relative phase between the $\phi_2$ and $\phi_1$ inputs thereto, and to modify the voltage seen across capacitor 74 so as to phase synchronize the two input signals.

A circuit has thus been described which generates a 38 kHz switching signal and a 19 kHz pilot signal which are in phase synchronism with one another. An automatic phase adjustment loop provides continuous adjustment of the phase between the 19 kHz pilot tone and the 38 kHz switching signal so as to eliminate the effects of aging, thermal drift, etc. In addition, a phase comparator has been described which does not include a voltage controlled oscillator, and which varies an output signal in response to any phase difference between two input signals.

Although the invention has been described with respect to a preferred embodiment, it will be appreciated that various arrangements and alterations of parts may be made without departing from the spirit and scope of the invention, as defined in the appended claims.

What is claimed is:

1. Apparatus for generating a pilot signal for use in an FM stereo modulating system and comprising:

means for generating a first square wave signal to be used as a switching signal in an FM stereo modulating system and a second square wave signal in phase synchronism therewith but having one-half the frequency thereof;

controllable phase shifter means responsive to said second signal for generating a phase adjusted signal having a phase adjusted in accordance with a control signal supplied to said controllable phase shifter means;

filter means for filtering said phase adjusted signal to remove all harmonics above the fundamental whereby said fundamental is provided at the output of said filter means and serves as said pilot signal;

high speed comparator means responsive to said pilot signal for deriving a square waveform therefrom which is synchronized in phase with said pilot signal; and, digital phase comparison means responsive to the relative logic states of said second signal and said square waveform derived from said pilot signal for determining therefrom the phase difference between said signals and providing said control signal in response to said phase difference so as to substantially synchronize the phase between said second signal and said pilot signal, whereby said pilot signal is substantially in phase synchronism with said switching signal.

2. Apparatus as set forth in claim 1, wherein said means for generating said switching signal and said second signal comprises clock means for generating a clock signal having a frequency which is a known multiple of the desired frequency of said switching signal and a parallel clocked, synchronous divider/decoder which is responsive to the clock signal for simultaneously providing a square wave switching signal and a square wave, second signal.

3. Apparatus as set forth in claim 1, wherein said signal generator means serves to provide two said second signals which are substantially in phase opposition with one another, and wherein said phase adjuster means comprises means for combining the two said second signals to provide a vector sum corresponding to said phase adjusted signal and for adjusting the contribution of each of said signals to said vector sum in accordance with said control signal whereby the phase of said vector sum signal is correspondingly adjusted.

4. Apparatus as set forth in claim 1, wherein said means for providing said control signal comprises a first flip-flop for providing first pulses having a pulse width corresponding to the amount by which said square wave form derived from said pilot signal leads said second signal, a second flip-flop for providing second pulses having a pulse width dependent upon the amount by which said square waveform derived from said pilot signal lags said second signal, and integrator means for integrating the difference between said first and second pulses to provide said control signal.

5. Apparatus for generating a pilot signal for use in an FM stereo modulating system and comprising:

means for synchronously generating a square wave switching signal and first and second square wave pilot signals such that said switching signal is twice the frequency of said square wave pilot signals and is in phase synchronization with said square wave pilot signals, and also such that said first and second square wave pilot signals are in phase opposition with one another;

controllable phase adjuster means for combining said first and second square wave pilot signals to provide a vector sum signal, and wherein said phase adjuster means responds to a control signal to vary the relative contribution of said square wave pilot signals to said vector sum signal whereby the phase of said vector sum signal is adjusted in accordance with said control signal;

filter means for filtering said vector sum signal to provide said pilot signal;

high speed comparator means for generating a third square wave signal substantially in phase synchronism with said pilot signal; and, phase comparator means for comparing the phase of two square waves of equal frequency and responsive to said first and third square wave signals to provide said control signal to said phase adjuster means.

6. Phase comparator apparatus for comparing the phase of first and second square wave signals and comprising:

a first flip-flop having a first output, a first edge-trigger input responsive to a specific type of logic transition in the signal appearing thereon for causing said output to assume a first logic state, and a second, level-trigger input responsive to a specific logic level in the signal appearing thereon for forcing said output to assume the logic state which is the logic inverse of said first logic state, regardless of the signal appearing on said first input;

a second flip-flop having a second output, a third edge-trigger input responsive to a specific type of logic transition in the signal appearing thereon for causing said output to assume a second logic state, and a fourth, level-trigger input responsive to a specific logic level in the signal appearing thereon for forcing said output to assume the logic state which is the logic inverse of said second logic state, regardless of the signal appearing on said third input;

means for directing said first signal to said first and fourth inputs and said second signal to said second and third inputs whereby said first flip-flop provides an output having first pulses having a pulse width corresponding to the amount by which said second signal lags said first signal, and said second flip-flop provides an output having second pulses having a pulse width corresponding to the amount by which said second signal leads said first signal; and, means responsive to said first and second output signals for providing a single phase difference signal indicating the difference in phase between said first and second signals.

* * * * *